United States Patent [19]

Selman

[11] 4,232,602

[45] Nov. 11, 1980

[54] PLATE LOADER FOR OFFSET PRINTING MACHINES

[75] Inventor: Thomas G. Selman, London, England

[73] Assignee: Gestetner Limited, London, England

[21] Appl. No.: 866,826

[22] Filed: Jan. 4, 1978

[30] Foreign Application Priority Data

Jan. 7, 1977 [GB] United Kingdom ..... 601/77
Sep. 9, 1977 [GB] United Kingdom ..... 37810/77

[51] Int. Cl.[3] ..... B41L 11/08

[52] U.S. Cl. ..... 101/132; 101/141; 101/232

[58] Field of Search ..... 101/132, 132.5, 141-145, 101/136-140, 147, 232-235

[56] References Cited

U.S. PATENT DOCUMENTS

| | | | |
|---|---|---|---|
| 2,798,426 | 7/1957 | Janke | 101/147 |
| 3,496,864 | 2/1970 | Tonkin | 101/142 |
| 3,521,560 | 7/1970 | Schmidlin | 101/145 |
| 3,589,286 | 6/1971 | Acks | 101/228 |
| 3,683,803 | 8/1972 | Gray | 101/132 |
| 3,858,508 | 1/1975 | Kaneko | 101/132 |
| 3,871,294 | 3/1975 | Kagari | 101/132.5 |
| 4,036,135 | 7/1977 | Raible | 101/132.5 |

FOREIGN PATENT DOCUMENTS

| | | | |
|---|---|---|---|
| 2281229 | 3/1976 | France | 101/132 |

*Primary Examiner*—Edgar S. Burr
*Assistant Examiner*—A. Heinz
*Attorney, Agent, or Firm*—Murray and Whisenhunt

[57] ABSTRACT

A plate loader for an offset printing machine includes means for allowing the loader to be pivoted between an operative position in which drive is automatically connected to the plate forwarding means of the plate loader, and a raised inoperative position in which drive is automatically disconnected from the plate forwarding means to allow plates to be fed by hand. The printing machine also includes an applicator for plate priming liquid, where the applicator is mounted movably on the machine frame for adjustment of the spacing between the plate delivery mechanism of the applicator and a stop position for the leading edge of a plate on the plate loader, in order to adjust for different plate lengths.

10 Claims, 7 Drawing Figures

PLATE LOADER FOR OFFSET PRINTING MACHINES

This invention relates to a plate loader for offset printing machines and to an offset printing machine incorporating such a loader.

Before being attached to a plate cylinder in an offset printing machine, for instance by a plate loader or manually, the non-image areas of an offset plate must, according to the plate type, be primed, converted or etched (although for the purpose of this application these proceedings will for convenience be referred to generically by the word "prime"). To this end it is usual to pass the plate through a bath or trough of an applicator in which the appropriate liquid contacts the surface of the plate. Some modern automatic offset machines are provided with an integral applicator, often in association either with a plate maker and/or a so-called "pack feeder" for plates, by which plates are fed singly from a stack through the applicator; plates are then carried on a conveyor system to a plate loader which loads the plates onto the plate cylinder when required.

In such arrangements, the conveyor has to be able to handle plates of different lengths and to drive them to a required point on a plate loader at which they will remain until they are required to be loaded onto the plate cylinder. Accordingly, the conveyor will be of a length not less than the length required to accommodate, in a primed condition, the largest plate to be employed with the machine concerned, and therefore it will usually be much longer than the average plate so that the equipment becomes excessively bulky overall. The conveyors used usually comprise tapes or bands and experience shows that after a period of use these become saturated with fluid from the applicator so that even if the area of contact between the tapes and the plate is kept to a minimum there may still be smudging or other distortions of the image on the printed copies which result.

As a result of overcoming practical difficulties in providing a conveyor which will operate with any degree of satisfaction, the conveyor has been developed into a form in which it is a permanent feature of the offset machine, in that it is in effect permanently coupled to both the applicator and other items such as a pack feed and plate maker, so that plates can only be used if they are passed, in turn, through the applicator and some or all of any auxiliary equipment there may be. While the potential printing capacity of a machine is increased by providing automatic plate makers, applicators and plate loaders, its flexibility is reduced in so far as it may be difficult or impossible satisfactorily to make, for instance a few prints from one or two extra plates when the machine has been set up to perform a long run involving a stack of plates which are already in position. This is a drawback in everyday use where it is often desirable to interrupt a run of straight edged plates undergoing automatic feed from a plate maker/pack feeder/primer applicator assembly to print one or more pin bar punched plates (i.e. plates having an array of holes or slots arranged along the top and bottom edges to be engaged by correspondingly arranged pins on the leading and trailing edge plate clamps of the plate cylinder).

According to one aspect of the present invention we provide an offset printing machine including a plate loader; an applicator for plate priming liquid, the applicator having a plate delivery mechanism; means for mounting the applicator movably on the offset machine so that the distance along the plate feed path between said plate delivery mechanism of the applicator and a stop position of the leading edge of the plate in the plate loader can be adjusted to be equal to different values of plate length. This eliminates the need for the conventional conveyor, with its associated disadvantages, because the primer plate delivery mechanism will advance the plate right up to the leading edge plate stop of the plate loader.

Another aspect of the present invention provides an offset printing machine having a plate loader carried by the frame of the offset printing machine; and means to feed plates to the plate loader; the plate loader being pivotable with respect to the frame of the offset printing machine between a raised, inoperative position and a lowered, operative position.

According to a further aspect, the present invention also provides a plate loader for use with an offset printing machine, such plate loader comprising: a plate support, a plate forwarding means for driving plates from said support along a feed direction, means for pivotally mounting said support on an offset printing machine, and a drive mechanism for said forwarding means, said drive mechanism being arranged to be connected automatically upon pivoting of said plate support into an operative position and to be disconnected automatically when said plate support is pivoted from its operative position.

Preferably said drive means to the sheet forwarding means comprise a gear wheel carried by said support and exposed to the underside of said support for automatically engaging with a further gear wheel of an offset printing machine on which said support is to be pivotally mounted. More preferably the plate forwarding means comprise a lower feed roller arranged to be in constant drive connection with the first mentioned gear wheel, for rotation whenever said gear wheel is rotating by driving action from the offset printing machine; and an upper feed roller mounted for movement towards and away from said lower feed roller; means being provided for controlling movement of said upper feed roller towards and away from said lower feed roller.

A further aspect of the present invention provides an offset printing machine having a plate cylinder equipped with a leading edge plate clamp to receive and clamp a plate leading edge; and a plate loader which includes a plate support,a pair of forwarding rollers for advancing a plate from said plate support towards the plate cylinder of said offset printing machine, and means responsive to the orientation of the plate cylinder of said offset printing machine for bringing the forwarding rollers into rolling contact for only a limited part of a revolution of the plate cylinder during which limited part of a revolution the plate leading edge is being advanced towards to be entrained by the plate clamp of the plate cylinder.

Advantageously, the movement-controlling means for said upper feed roller comprises a cam follower roller pivotally carried by a support arm by which support arm the upper feed roller is carried, said cam follower roller being arranged to engage with a suitable cam carried by the plate cylinder of the offset printing machine.

Conveniently the plate loader further includes a latch mechanism for holding said support arm in a given position in which the upper feed roller is spaced from and above said lower feed roller, and also means for rotating said operating latch to allow descent of the upper feed roller onto the constantly rotating lower feed roller in response to movement of said cam follower roller.

The cam mounted on the plate cylinder conveniently has a substantially constant circular periphery with a "dip" defining a recess into which said cam follower roller of the plate loader can descend when the plate loader is in an operative position with respect to the printing machine, and the plate cylinder is in a position ready to receive a plate, and said latch is in a position releasing said support arm to allow said cam follower roller to enter said dip.

The invention will be more clearly understood from the following description which is given by way of example only with reference to the accompanying drawings, in which.

Figure 1:
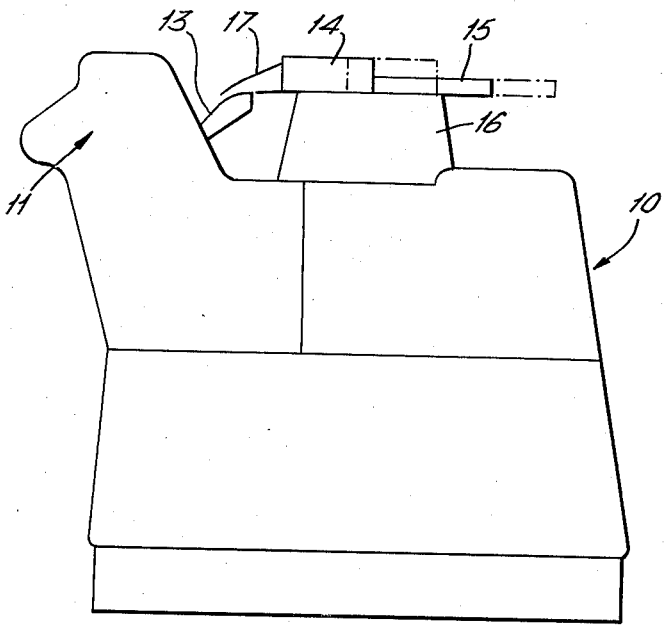
FIG. 1 is a general side view of a printing machine according to the invention.

FIG. 1 shows an offset printing machine illustrated generally at 10 having an upstanding part 11 at one end at which is located inter alia a plate cylinder not shown. A plate loader 13 is provided in the vicinity of the plate cylinder to load straight edged plates automatically onto the plate cylinder. A priming liquid applicator 14 and stack loader 15 are together movably mounted on a frame part 16 of the machine between, for instance, the positions in which they are shown in full and dotted lines. Guides 17 extend from the applicator to the plate loader 13.

This arrangement is more compact than previous arrangements in that the applicator can be as close to the plate loader as the size of plate allows. In previous arrangements the applicator is well to the right, as shown, and fixed.

Figure 2:
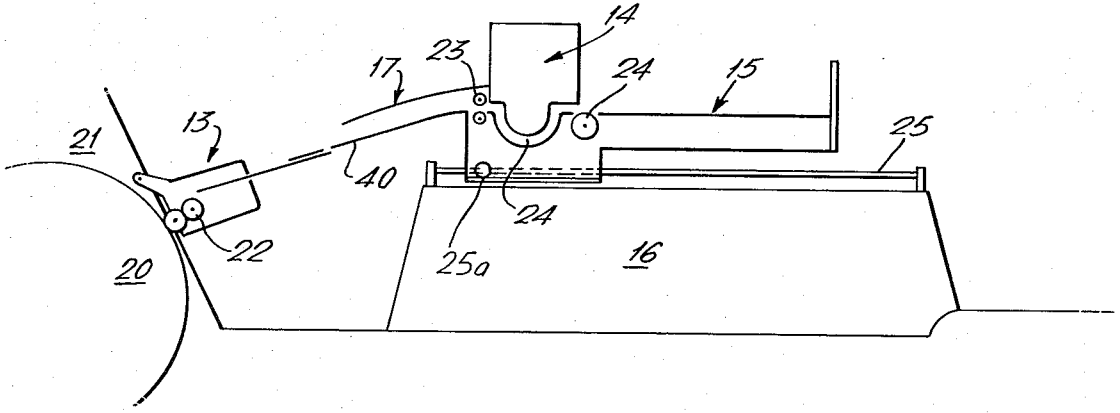
FIG. 2 is a more detailed but schematic partial side view of the machine.

The more detailed view of FIG. 2 shows part of a plate cylinder at 20 between a pair of side frames of which one is indicated at 21. The plate loader 13 is pivoted to the side frames and has a lower feed roller 22 to be driven from a gear 34 on the plate cylinder via an idler gear 53 (FIG. 3), as will be described below, for the purpose of forwarding plates. The applicator has top and bottom downwardly inclined guide plates or sets of fingers 17 leading from forwarding rollers 23 at the exit from a trough 24 to contain primer. The pack feeder 15 is shown to be of the bottom feed type having a forwarding roller 24'. The applicator and pack feeder are slideable on rails 25 on the part 16 and can be fixed at the required position by operation of a clamping screw 25*a*.

Guides may extend rearwardly from the plate loader 13, for instance overlapping guides 17 or some other arrangement can be provided to give a surface for supporting plates upon ejection from the forwarding rollers 23 of the priming liquid applicator 14.

Figure 4:
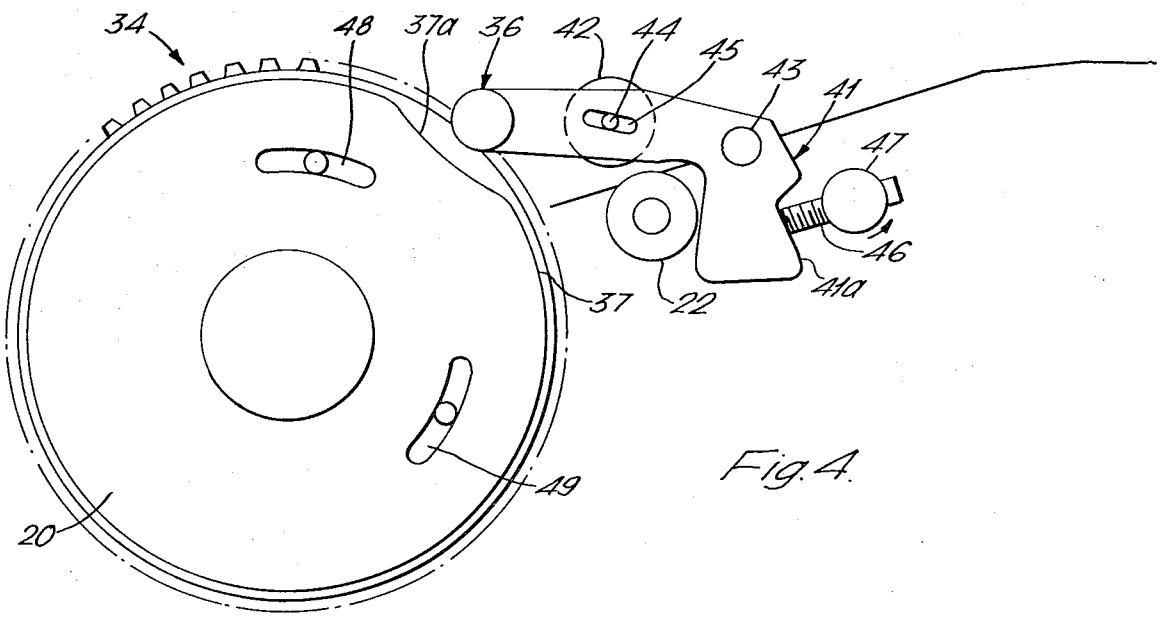
FIG. 4 is a view from the same side as FIG. 3, but showing in greater detail the drive roller lifting mechanism.

FIG. 4 shows, in more detail, one of the support arms 41 which carry the upper feed roller 42 and are themselves pivotally carried by a pivot shaft 43.

The particular support arm 41 shown in FIG. 4 is the one on which the cam follower rollers 36 are mounted, but it will be understood that there will be another arm 41, which may or may not carry its own cam follower roller 36, at the other side of the plate loader so that these two arms between them support the upper feed roller 42.

As shown in FIG. 4, the feed roller 42 has at each end an adjusting screw 44 which will be described in more detail below with reference to FIGS. 6*a* and 6*b*.

As shown in FIG. 4, a latching mechanism for the support arm 41 includes a latch stud 46 extending diametrically of an actuating shaft 47 so that, in the position shown in FIG. 4, the cam follower roller 36 will always be held clear of the dip 37*a* of the cam 37 and this will correspond to the normal printing position of the Offset printing machine and plate loader.

The actuating shaft 47 is, however, pivotable in the anti-clockwise direction to bring the latch stud 46 away from engagement with the heel 41*a* or arm 41 thereby allowing the cam follower roller 36 to descend into the dip 37*a* to bring the upper feed roller 42 down into contact with the plate on the lower feed roller 22 and to press the plate against the already rotating lower feed roller 22 to cause plate feed.

Figure 3:
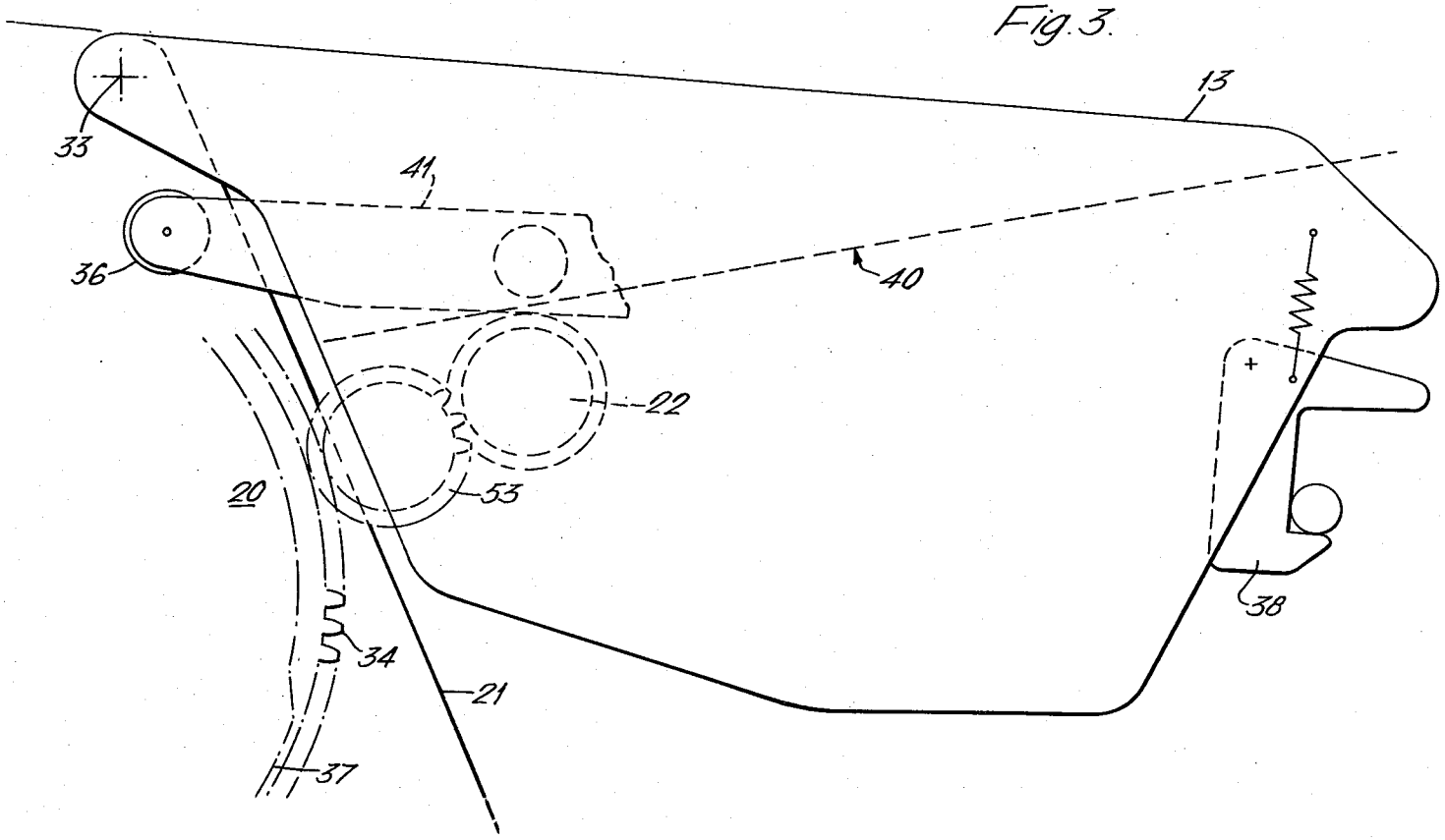
FIG. 3 is a partial side view in greater detail showing the plate loader.

The continuous rotation of the lower feed roller 22 will be evident from the gearing arrangement, involving idler pinion 53, in FIG. 3.

Also shown in FIG. 4 are two timing slots 48 and 49 formed in the end cam 37 so that it is possible to re-position, angularly, the orientation of the cam 37 with respect to the plate cylinder 20 and thereby to alter the timing of the feeding operation of the plate loader with respect to the position of the plate cylinder.

Figure 6A:
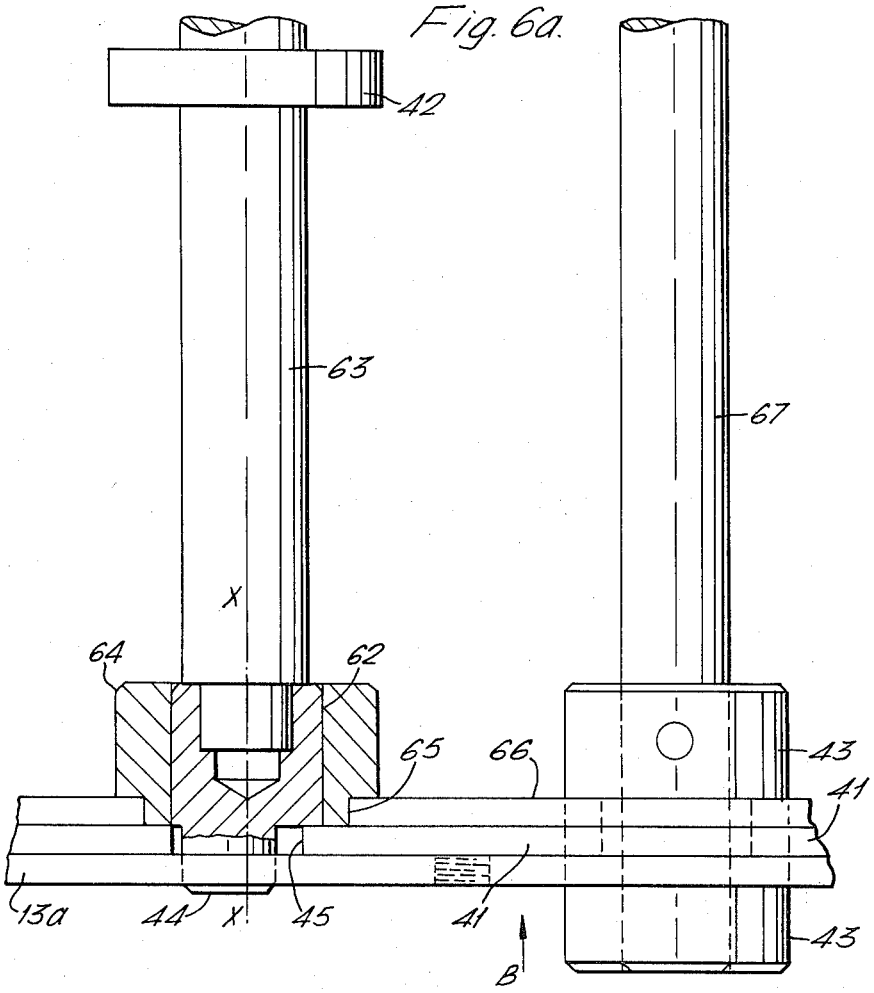
FIGS. 6*a* and 6*b* show a top plan view and a side elevational view, respectively, of the adjustment means for the top plate feed rollers.
Figure 6B:
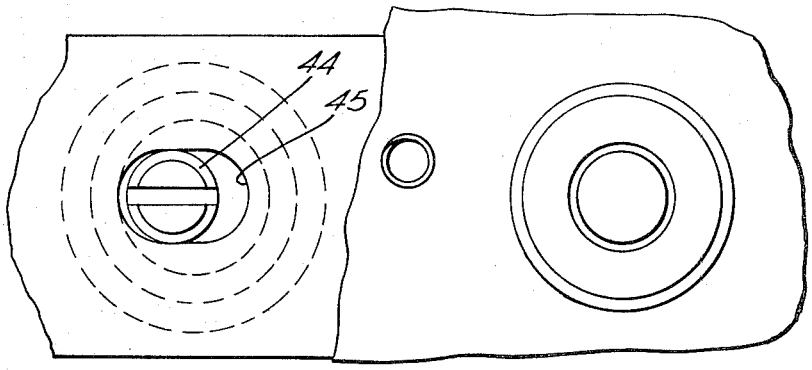

The adjustment screw 44 referred to above with reference to FIG. 4 can be seen more clearly in FIGS. 6*a* and 6*b* which show the rest of the mechanism for adjusting the height of the feed rollers in relation to the position of the swinging arms 41.

By raising or lowering the location of the feed rollers with respect to the swinging arms 41, bearing in mind that the arms 41 are driven through a given angular deflection by the cam follower roller 36 riding in the cam trough 37*a* on the plate cylinder, it is possible to vary the duration of the contact of the top feed rollers 42 with the paper plate on the lower feed rollers 22 and hence to vary the length of the travel through which that plate will be positively driven.

Thus, lowering the location of the upper feed rollers 42 with respect to the arm 41 will give rise to a situation where the rollers 42 and 22 will contact one another earlier on during the anticlockwise "lowering" movement of the arms 41 (as viewed in FIG. 4), and will equally separate later during clockwise "raising" movement of the arms 41 as the cam follower roller 36 leaves trough 37*a*. Conversely, raising the location of the feed rollers 42 with respect to the arm 41 will delay the coming together of the rollers 42 and 22 and will make them separate earlier.

This is achieved by means of an eccentric adjusting screw 44 on the end of each bearing cap 62 of the support shaft 63 for the various upper feed rollers 42. The bearing cap 62 is itself carried by a collar 64 which has an annular spigot 65 snugly seated in a circular recess of a secondary arm 66 which, together with its arm 41 referred to above is mounted for pivotal movement about the axis of symmetry of a bipartite pivot bearing 43 (illustrated also in FIG. 4). This bearing 43 is in turn linked to another similar bipartite pivot bearing 43 at the opposite side of the machine by means of a cross shaft 67.

The side frame 13*a* of the plate loader is also shown in FIG. 6*a*.

The slot 45 (shown in FIGS. 4, 6*a* and 6*b*) extends in a radial direction with respect to the axis of pivot bearing 43 and ensures that during rotation of the adjusting screw 44, which in turn rotates the bearing cap 62 within the collar 64, the screw head can traverse in the radial direction, as viewed in FIGS. 4 and 6*b*, although it is held against movement in the circumferential direction by means of the upper and lower walls of the slot 45. It is this constraint against circumferential (i.e. vertical) motion which ensures that, during rotation of the screw 44, the secondary arm 66 must pivot (about the axis of cross shaft 67) thereby raising and lowering the axis X—X of the shaft 63 on which the upper feed rollers 42 are mounted.

Starting from the position illustrated in FIG. 6*b*, rotating the adjuster screw 44 in the anticlockwise direction will raise the location of the axis X—X by clockwise pivoting of the secondary arm 66 with respect to the arm 41 (when viewed in the direction of viewing in FIG. 6*b*, in other words along the direction of arrow B in FIG. 6*a*), whereas clockwise rotation of the adjuster screw 44 from the FIG. 6*b* position will lower the position of the shaft 63 and feed rollers 42.

Naturally, a similar adjustment mechanism is necessary for the arm 41 and secondary arm 66 at the opposite side of the machine, and will need to be adjusted separately in order to ensure that the axis X—X remains parallel to the axis common to the lower feed rollers 22.

Figure 5:
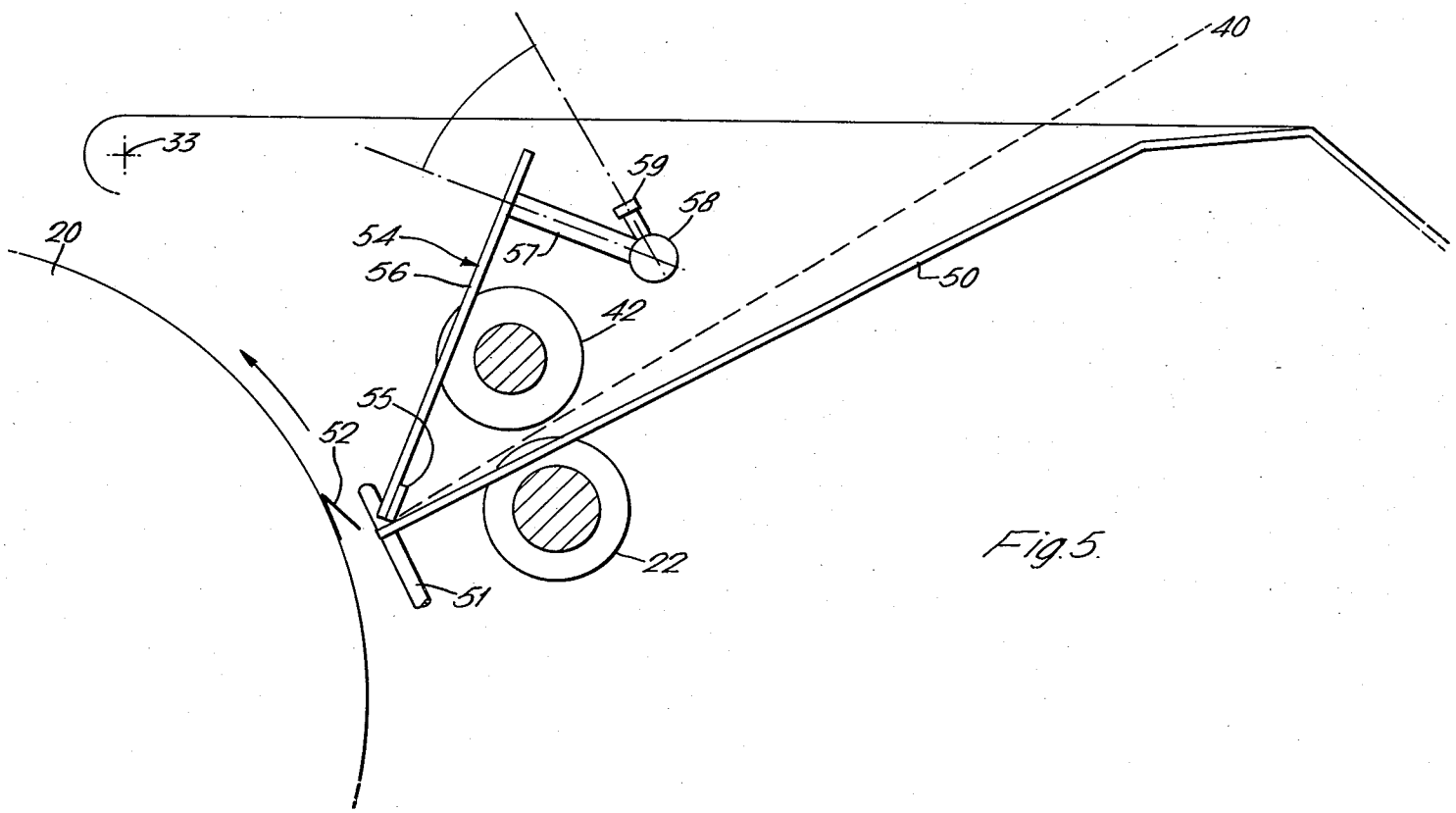
FIG. 5 is another side view, from the same side, but showing the anti-curl guard for preventing the edges of a primed plate from curling up and becoming insecurely held by the plate clamp of the offset printing machine.

FIG. 5 shows a guard preventing the plates from curling up at the edges during feeding to the plate cylinder 20.

In FIG. 5, as also in FIG. 3, the dotted line 40 shows the direction of plate movement into the plate loader. At the end of the plate support 50 which defines this plate path is a plate stop 51 which is retractable at the start of a plate feeding cycle, by means not shown, to release the plate for forward movement when it becomes entrained by the lower and upper plate feed rollers 22 and 42.

As the plate is driven forwards by the two rollers 22 and 42, its leading edge will enter the plate clamp 52 of the plate cylinder 20 to become clamped thereby and then have the leading edge deflected in an upward direction around the plate cylinder 20. At this time the plate clamp 52 will become automatically closed by means which are well known in the printing machine art and do not require detailed explanation at this time.

Once the plate leading edge has been entrained by the leading edge clamp 52 the cam follower roller 36 will be lifted by the end of the dip 37*a* and cam 37, the latch actuating shaft 47 will rotate back to the FIG. 4 position to hold the heel 41*a* of the arm 41 before the dip 37*a* next arrives in register with the cam follower roller 36, and the sheet leading edge stop 51 will once again be extended through the plane of the plate guide 50.

The advantage of the lifting and lowering action of the upper feed roller 42, under the influence of the cam follower roller 36 riding on the edge cam 37 of the plate cylinder 20, is that the upper feed roller 42 only contacts the damp upper face of the already primed plate for a very small period whilst the plate is forwarded into the plate clamp 52 and thus there will be the minimum of contact of the upper feed roller 42 with the damp, primed plate. It is well known that excessive contact with the primed surface of an offset plate can result in drying off, and hence inadequate priming, of certain regions of the plate with the result that ink may adhere to the non-image areas and cause a marring of the otherwise clear background to the image on the printed copy. There will of course be a very slight rubbing contact of the pad 55 (FIG. 5), which defines a curl-straightening edge of the anti-curl guard 54, on the wet plate surface but this will not be likely to detract from the degree of uniformity of priming of the plate to an extent sufficient to mark the non-image areas.

By way of explanation, the operation of the plate feeder, primer and loader assembly will now be described.

Initially the bottom plate of a stack in the pack feeder 15 is driven forward through the priming liquid applicator 14 and onto the plate guide 50 where its leading edge is accurately located by contacting the now extended stop 51. The applicator 14 and pack feeder 15 will be so positioned that when a plate abuts the leading edge stop 51 in the plate loader the plate trailing edge will be just clear of the forwarding rollers 23 of the primary liquid applicator 14.

In automatic use, a primed straight-edged plate is kept ready in the plate loader 13 and supported on the guide 50. When the required number of copies has been made with the preceding plate, that plate is ejected automatically, for example by linkage connecting the "copy" counter (not shown) with a plate ejector cooperating with the plate clamp 52. The next, already primed, plate is loaded on to the plate cylinder and when this occurs, the next successive plate to be printed is taken from the bottom of the stack on the pack feeder 15, through the applicator 14, and onto the guides 17 up to the stops 51 in the plate loader 13 to await use.

A plate maker may also be provided as a fixed part of the machine, for instance at the right end as shown.

In order that this arrangement should not exclude the possibility of plates being hand-loaded by the operator, and in order to allow easy access to the plate cylinder for cleaning and/or maintenance, or to allow pin bar punched plates to be loaded, the plate loader 13 is pivotable to and from the operational position in which it is shown. FIG. 3 shows the plate loader 13 to be pivoted to side frames 21 at a point 33. Spring loaded latches 38 engage projections to hold the plate loader in the operational position.

As explained above, the drive to the plate loader is taken from the gear 34 on the axis of the plate cylinder 20 via the idler gear 53 mounted in the pivotal plate loader 13. Upon pivoting movement of the plate loader about the mounting pivot 33, the idler gear 53 is moved into or out of mesh with the cylinder gear 34, so that coupling and uncoupling of the drive connection to the plate loader 13 is completely automatic upon movement thereof.

Pivotal movement of the plate loader in the anticlockwise direction about the mounting pivot 33 also automatically breaks the actuating drive to the raising and lowering upper feed rolls 42 in that the cam follower roller 36 quite simply lifts away from the surface of the plate cam 37. Thus there is absolutely no separate disconnection required other than simply pivoting the plate loader. Removal ofthe entire plate loader assembly can equally simply be carried out if the pivot mounting 33 is made of "quick-release" form.

When the plate loader 13 is in the position illustrated in FIGS. 3 and 4 it operates in the normal manner to load plates when signalled to do so, but when raised it allows access to the plate cylinder 20 and surrounding parts of the machine so that plates, e.g. pin bar punched plates, may be individually positioned on the plate cylinder by the operator, an existing large run of printing being perhaps interrupted for the purpose.

I claim:

1. In an offset printing machine including a plate cylinder, and a plate loader which plate loader comprises a plate support; a plate forwarding means for driving said plates from said support along a feed direction; means mounting said support on an offset printing machine; and a drive mechanism for said forwarding means; the improvement wherein said plate loader mounting means include pivot means defining an axis of pivoting of said plate loader with respect to said offset printing machine, said axis being parallel to said plate cylinder, and said drive mechanism includes means automatically engageable to transmit drive upon pivoting of said plate loader into an operative position and automatically disengageable to interrupt drive when said plate support is pivoted from its operative position.

2. An offset printing machine according to claim 1, wherein said means automatically engageable and disengageable comprise a first gear wheel carried by said plate support and exposed to the underside of said support, and a second gear wheel carried by said offset printing machine and positioned to automatically engage with said gear wheel of the plate loader.

3. An offset printing machine according to claim 1, wherein the plate forwarding means comprise a lower feed roller arranged to be in constant drive connection with said first gear wheel, for rotation whenever said first gear wheel is rotating by driving action from said second gear wheel of the offset printing machine; an upper feed roller mounted for movement towards and away from said lower feed roller; and means for controlling movement of said upper feed roller towards and away from said lower feed roller.

4. An offset printing machine according to claim 1, and including a machine frame; stop means on said plate loader to be engaged by the leading edge of a plate to be fed from said plate loader to said plate cylinder; applicator means for applying plate priming liquid to plates to be printed, said applicator means having a plate delivery mechanism; guide means guiding a primed plate from said applicator means to said stop means on said plate loader when said plate support is in said operative position; and means mounting said applicator means movably on said frame for movement towards and away from said plate loader, whereby the distance between said plate delivery mechanism of the applicator means and said stop means for the leading edge of the plate in the plate loader can be adjusted to be equal to different values of plate length.

5. An offset printing machine according to claim 4, and including a plate pack loader for dispensing sheets one at a time from a stack, said pack loader being mounted adjacent said applicator means to feed plates thereto, wherein said means movably mounting the applicator means on said frame comprise a support connected to the frame of the offset printing machine, and wherein said applicator means and said pack loader are slidably carried by said support.

6. An offset printing machine according to claim 5, and including means for locking said pack loader and said applicator means in a desired position on said support.

7. An offset printing machine according to claim 4, wherein said plate delivery mechanism of the applicator means comprise ejection rolls positioned at the outlet of the applicator means to advance primed plates towards the plate loader.

8. An offset printing machine according to claim 4 wherein said plate loader includes a plate support and said plate guide means extend between the said plate delivery mechanism of the applicator means and said plate support of the plate loader.

9. An offset printing machine according to claim 8, wherein said guide means slopes downwardly towards the plate loader.

10. In an offset printing machine including a frame; a plate cylinder; a plate loader having stop means to be engaged by the leading edge of a plate to be fed from said loader to said plate cylinder; applicator means for applying plate priming liquid to plates to be printed, said applicator means having a trough for a plate priming solution and a pair of rolls defining a nip through which the wet plate is drawn on its removal from the trough; and first guide means guiding a primed plate from said nip-defining rolls to said stop means; the improvement comprising second guide means slidably supporting said applicator means movably on said frame for movement towards and away from said plate loader, whereby the distance between said nip-defining rolls of the applicator means and said stop means for the leading edge of the plate in the plate loader can be adjusted to be equal to different values of plate length; and means for locking said applicator means in a desired position on said second guide means.

* * * * *